US010415833B2

(12) United States Patent
Kapilavai et al.

(10) Patent No.: US 10,415,833 B2
(45) Date of Patent: Sep. 17, 2019

(54) PREMIXER FOR GAS TURBINE COMBUSTOR

(71) Applicant: General Electric Company, Schenectady, NY (US)

(72) Inventors: Sravan Kumar Dheeraj Kapilavai, Schenectady, NY (US); Jin Yan, Schenectady, NY (US); Anthony John Dean, Scotia, NY (US)

(73) Assignee: GENERAL ELECTRIC COMPANY, Niskayuna, NY (US)

( * ) Notice: Subject to any disclaimer, the term of this patent is extended or adjusted under 35 U.S.C. 154(b) by 547 days.

(21) Appl. No.: 15/434,830

(22) Filed: Feb. 16, 2017

(65) Prior Publication Data

US 2018/0340688 A1 Nov. 29, 2018

(51) Int. Cl.

| | |
|---|---|
| ***F23R 3/28*** | (2006.01) |
| ***F23R 3/46*** | (2006.01) |
| *F23D 14/02* | (2006.01) |

(52) U.S. Cl.

CPC ..... *F23R 3/286* (2013.01); *F23R 3/46* (2013.01); *F23D 14/02* (2013.01)

(58) Field of Classification Search

CPC .. F23R 3/46; F23R 3/283; F23D 2900/00008; F23D 2900/00012; F23D 2900/14002; F23D 2900/14021; F23D 2900/14701; F23D 14/02

See application file for complete search history.

(56) References Cited

U.S. PATENT DOCUMENTS

| | | | |
|---|---|---|---|
| 6,532,743 | B1 | 3/2003 | Fischer |
| 6,968,692 | B2 | 11/2005 | Chin et al. |
| 7,513,100 | B2 | 4/2009 | Motter et al. |
| 8,197,249 | B1 | 6/2012 | Nguyen |

(Continued)

FOREIGN PATENT DOCUMENTS

| | | | |
|---|---|---|---|
| CN | 105423341 | A | 3/2016 |

OTHER PUBLICATIONS

Fully Premixed, Low Emission, High Pressure, Multi-fuel Burner, NASA Information on the American Recovery and Reinvestment, http://technology.grc.nasa.gov/patent/TOP3-406.

(Continued)

*Primary Examiner* — Craig Kim

(74) *Attorney, Agent, or Firm* — Fletcher Yoder, P.C.

(57) ABSTRACT

A gas turbine engine includes a combustor and a turbine. The combustor includes a pre-mixer having a body defining a plurality of fluid passages extending axially through the pre-mixer, wherein a cross-sectional projection of each of the plurality of fluid passages comprises one or more features that form a helical coil about an axis of the fluid passage along a length of the fluid passage, wherein the pre-mixer is configured to receive fuel from a fuel supply, receive air from an air supply, mix the fuel and air by flowing the fuel and air through the plurality of fluid passages, and imparting a swirling motion on the fuel and air, and supply the air-fuel mixture to a combustion zone. The combustor is configured to combust the air-fuel mixture, generating combustion fluids. The turbine is configured to receive the combustion fluids from the combustor and to use the combustion fluids to drive one or more stages of the turbine.

17 Claims, 8 Drawing Sheets

(56) References Cited

U.S. PATENT DOCUMENTS

| | | | | |
|---|---|---|---|---|
| 9,134,023 | B2 | 9/2015 | Boardman et al. | |
| 9,261,279 | B2 | 2/2016 | Westmoreland et al. | |
| 9,400,113 | B2 | 7/2016 | Ogata et al. | |
| 2013/0167539 | A1 | 7/2013 | Berry | |
| 2014/0144142 | A1 | 5/2014 | El-Nabi et al. | |
| 2014/0238026 | A1* | 8/2014 | Boardman | F02C 7/24 60/742 |
| 2015/0076251 | A1 | 3/2015 | Berry | |
| 2015/0275755 | A1 | 10/2015 | Ogata et al. | |
| 2017/0241644 | A1* | 8/2017 | Cihlar | F23R 3/46 |

OTHER PUBLICATIONS

Tanaka, Yusuke, et al.; Development of Low NOx Combustion System with EGR for 1700° C.-Class Gas Turbine, Mitsubishi Heavy Industries Technical Review, Mitsubishi Heavy Industries Technical Review, https://www.mhi.co.jp/technology/review/pdf/e501/e501001.pdf, vol. 50, Issue 1, Mar. 2013.

New Gas Turbine Combustor for Record Low NOx Emissions, Penn Well Corporation, http://www.decentralized-energy.com/articles/print/volume-12/issue-6/features/new-gas-turbine-combustor-for-record-low-nox-emissions.html, Nov. 1, 2011.

* cited by examiner

PREMIXER FOR GAS TURBINE COMBUSTOR

BACKGROUND

The subject matter disclosed herein relates to gas turbine engines, and more specifically pre-mixers in a combustor of a gas turbine engine.

In a gas turbine engine, combustible materials (e.g., fuel mixed with air) are combusted in a combustor, producing high-energy combustion fluids. The combustion fluids are directed to a turbine via a transition duct, where the combustion fluids aerodynamically interact with turbine blades, causing them to rotate. The turbine may be coupled to a compressor by one or more shafts such that the rotating blades of the turbine drive the compressor. The turbine may be used to generate electricity, power a load, or some other use.

BRIEF DESCRIPTION

Certain embodiments commensurate in scope with the original claims are summarized below. These embodiments are not intended to limit the scope of the claims, but rather these embodiments are intended only to provide a brief summary of possible forms of the claimed subject matter. Indeed, the claims may encompass a variety of forms that may be similar to or different from the embodiments set forth below.

In one embodiment, a gas turbine engine includes a combustor and a turbine. The combustor includes a pre-mixer having a body defining a plurality of fluid passages extending axially through the pre-mixer, wherein a cross-sectional projection of each of the plurality of fluid passages comprises one or more features that form a helical coil about an axis of the fluid passage along a length of the fluid passage, wherein the pre-mixer is configured to receive fuel from a fuel supply, receive air from an air supply, mix the fuel and air by flowing the fuel and air through the plurality of fluid passages, and imparting a swirling motion on the fuel and air, and supply the air-fuel mixture to a combustion zone. The combustor is configured to combust the air-fuel mixture, generating combustion fluids. The turbine is configured to receive the combustion fluids from the combustor and to use the combustion fluids to drive one or more stages of the turbine.

In a second embodiment, a pre-mixer for a gas turbine combustor, includes a body defining a plurality of fluid passages extending axially through the pre-mixer, wherein a cross-sectional projection of each of the plurality of fluid passages comprises one or more features that form a helical coil about an axis of the fluid passage along a length of the fluid passage. The pre-mixer is configured to receive fuel from a fuel supply, receive air from an air supply, and mix the fuel and air by flowing the fuel and air through the plurality of fluid passages, and imparting a swirling motion on the fuel and air.

In a third embodiment, a method of mixing fuel and air in a pre-mixer of a gas turbine engine combustor includes receiving fuel from a fuel supply, receiving air from an air supply, directing the air and fuel through a plurality of fluid passages of a pre-mixer, wherein a cross-sectional projection of each of the plurality of fluid passages comprises one or more features that form a helical coil about an axis of the fluid passage along a length of the fluid passage, and directing the fuel and air to a combustion zone of a combustor.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

Combustible materials are combusted in a combustor of a gas turbine engine to form high-energy combustion fluids, which are directed to a turbine. In the turbine, the combustion fluids aerodynamically interact with blades, causing the blades of the turbine to rotate. By more thoroughly mixing a fuel into the compressed air supplied to the combustor, a more complete combustion reaction may be achieved, resulting in a large percentage of combustible material consumption and reduced emissions. Specifically, by passing the compressed air and the fuel through a pre-mixer that induces a swirling motion in the fuel and compressed air, the fuel-air mixture exiting the pre-mixer may be more thoroughly mixed. For example, in one embodiment, the pre-mixer may include a plurality of fluid flow paths, wherein each flow path has a lobed cross-section that twists along the length of the flow path, inducing a swirling motion in fluids passing through the flow path, resulting in more thoroughly mixed fuel and compressed air. In some embodiments, the dimensions of the cross section of the flow path may shrink along the length of the flow path, resulting in a tapered flow path.

Figure 1:
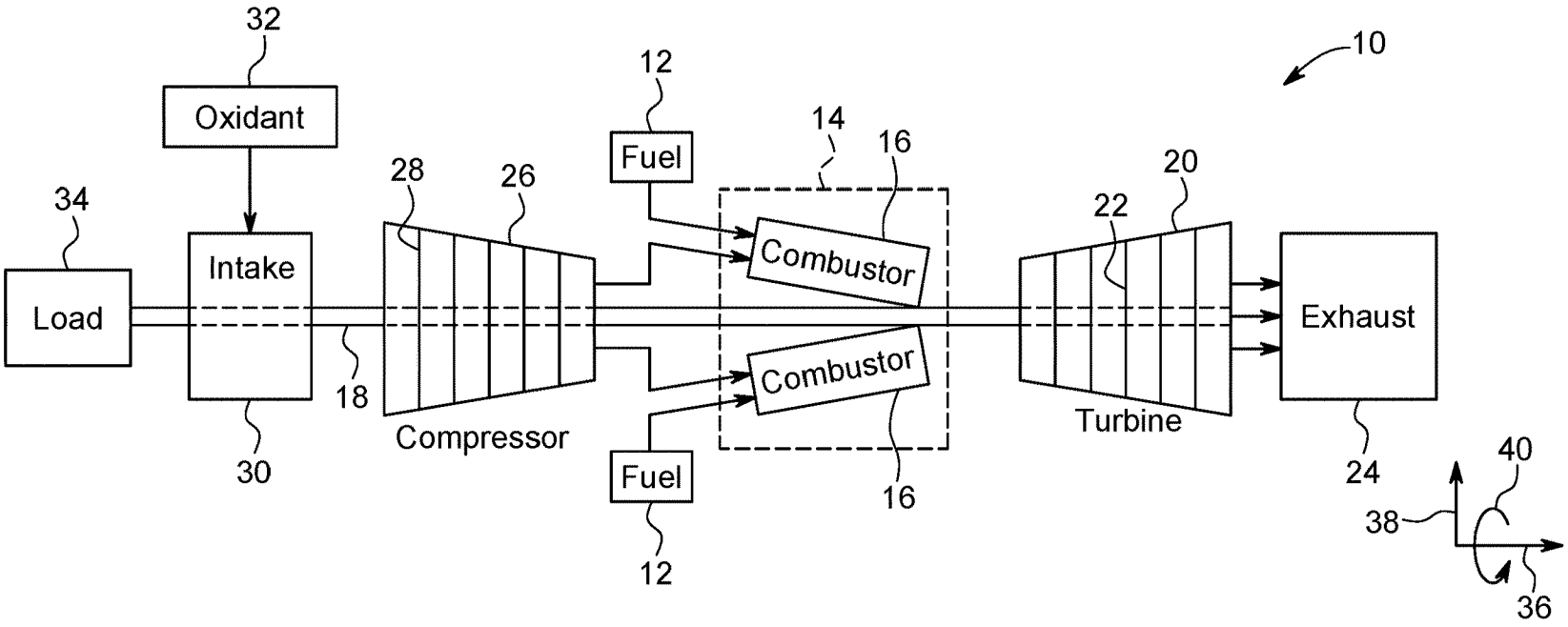
FIG. 1 PRIOR ART
FIG. 1 is a block diagram of a gas turbine engine, in accordance with an embodiment.

Turning now to the figures, FIG. 1 is a block diagram of an embodiment of a turbomachine system (e.g., gas turbine engine 10). The gas turbine engine 10 may use liquid and/or gas fuel to drive the gas turbine engine 10. The fuel may be any suitable gaseous or liquid fuel, such as natural gas, liquefied natural gas (LNG), syngas, associated petroleum gas, methane, ethane, butane propane, biogas, sewage gas, landfill gas, coal mine gas, gasoline, diesel, naphtha, kerosene, methanol, biofuel, or any combination thereof. Fuel may be directed from one or more fuel supplies 12 to a combustor section 14. The fuel may be mixed with oxidant, such as compressed air, at one or more points in the combustor section 14. The oxidant-fuel mixture combusts in one or more combustors 16 (e.g., combustor cans) of the combustor section 14, thereby creating hot pressurized combustion gases.

In some embodiments, the gas turbine engine 10 may include combustors 16 disposed about a shaft 18. Each combustor 16 may direct combustion gases into a turbine 20, which may have one or more stages 22, toward an exhaust outlet 24. Each stage 22 may include a set of blades coupled to a respective rotor wheel, coupled to the shaft 18. As the combustion gases cause rotation of turbine blades, the shaft 18 rotates to drive a compressor 26. Eventually, the gas turbine engine 10 exhausts the exhaust gases through the exhaust outlet 24.

One or more stages 28 of the compressor 26 compress the oxidant (e.g., air) from the oxidant intake 30. The one or more stages 28 may be coupled to the shaft 18. Each stage 28 includes blades that rotate to increase the pressure and to provide compressed oxidant. As the blades within the compressor 26 rotate, oxidant is drawn from an oxidant supply 32.

The compressed discharge oxidant from the compressor 26 is directed into one or more combustors 16 in the combustor section 14 to mix with the fuel. For example, fuel nozzles of the combustor section 14 may inject fuel and compressed oxidant into the combustors 16 in a suitable ratio for combustion. For example, suitable combustion may substantially completely combust the fuel with minimal emissions.

The shaft 18 may also be coupled to a load 34, which may be a mobile or a stationary load, such as a propeller on an aircraft or an electrical generator in a power plant. The load 34 may include any suitable device capable of being powered by the rotational output of the gas turbine engine 10.

By combusting a fuel-air mixture that is thoroughly mixed, the combustors 16 may achieve more complete combustion, which may reduce the total emissions of the tubromachine 10.

Figure 2:
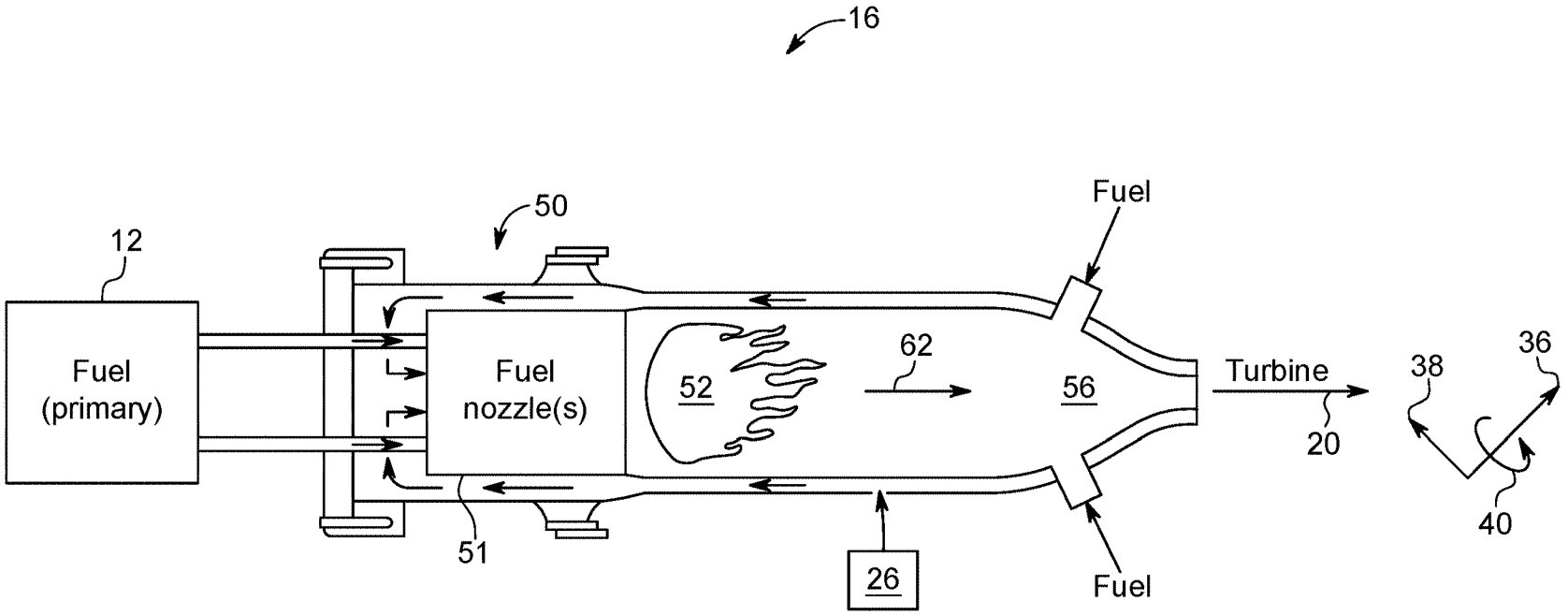
FIG. 2 PRIOR ART
FIG. 2 is a schematic of a combustor of the gas turbine engine of FIG. 1, in accordance with an embodiment.

FIG. 2 is a schematic of an exemplary combustor 16. The combustor has a head end 50, which includes one or more fuel nozzles 51, that mix fuel from the primary fuel supply 12 with air from the compressor 26. The fuel/air mixture is combusted in a first combustion zone 52. The fluids then travel down the combustor 16, through a transition duct, which may include a second combustion zone 56. In some embodiments, additional fuel may be injected into the transition duct (e.g., by one or more axial fuel staging injectors) as the fluids travel to the turbine 20. A pre-mixer 51 that imparts a swirling or twisting motion in the fluids that flow through it (e.g., fuel and compressed air) may result in a more thoroughly mixed fuel-air mixture, encouraging more complete combustion, which may reduce certain emissions (e.g., NOx emissions).

Figure 3:
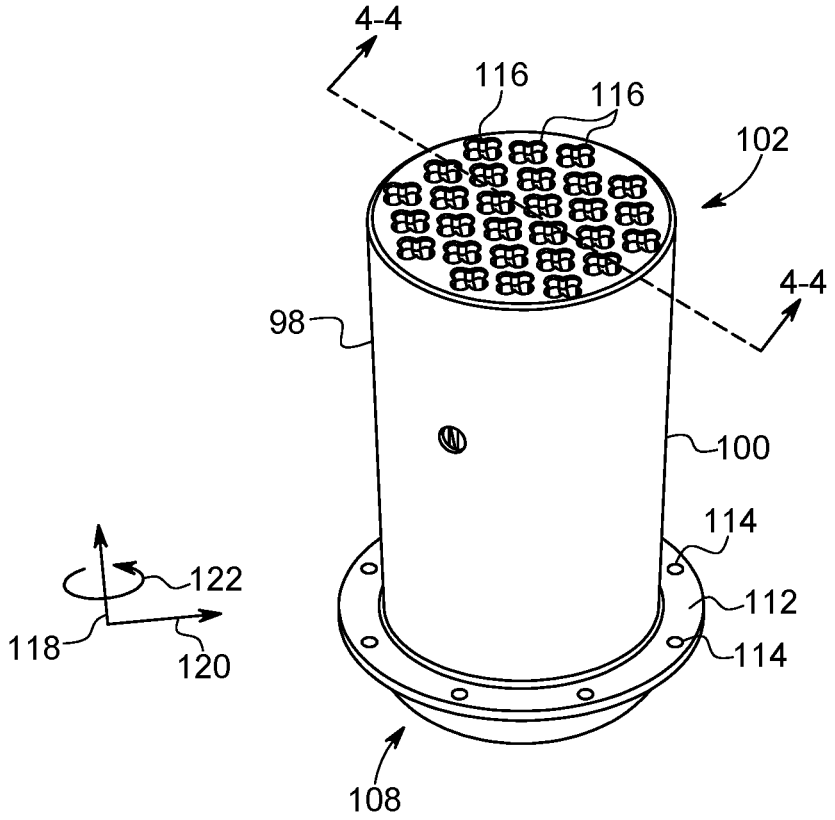
FIG. 3 is a perspective view of a pre-mixer of the combustor shown in FIG. 2, in accordance with an embodiment.
Figure 4:
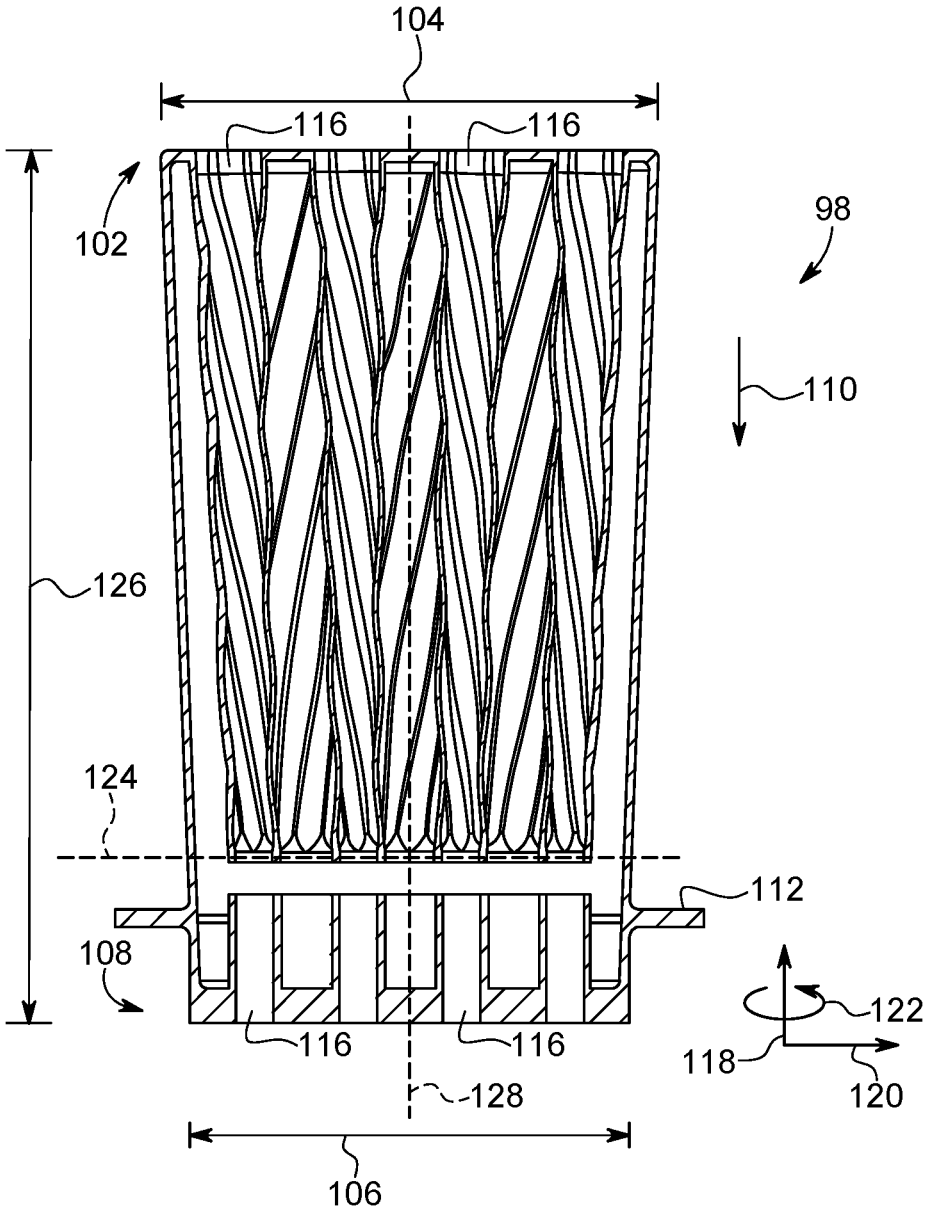
FIG. 4 is a side, section view of the pre-mixer of FIG. 3, taken along line 4-4, in accordance with an embodiment.

FIG. 3 is a perspective view of a pre-mixer 98, which may be a part of the fuel nozzles 51 shown in FIG. 2, in accordance with an embodiment. FIG. 4 is a side, section view of the pre-mixer 98 of FIG. 3, taken along line 4-4, in accordance with an embodiment. FIGS. 3 and 4 are discussed together for clarity. The pre-mixer 98 includes a body 100. The body 100 may be made by additive manufacturing (e.g., 3D printing), molding, machining, other manufacturing techniques, or a combination thereof. In the illustrated embodiment, the body 100 is tapered such that a first, upstream, end 102 has a first diameter 104 that is larger than a second diameter 106 of a second, downstream, end 108. The pre-mixer 98 may be installed in the combustor 16 (see FIG. 2) such that fluid flows in a direction 110 from the first end 102 to the second end 108. The pre-mixer 98 includes a flange 112 proximate the second end 108 of the body 100. The flange 112 includes a number of apertures 114 circumferentially spaced about the flange 112, which may be configured to receive fasteners. The flange 112 may be used as a mounting interface for installation of the pre-mixer 98 within the combustor 16. However, embodiments of the pre-mixer 98 with mounting interfaces different from the flange 112 are also envisaged.

The pre-mixer includes flow paths 116 extending in an axial direction 118 through the body 100 of the pre-mixer 98. As will be described in more detail below, a cross-section of each flow path 116 may include lobes that extend outward in a radial direction 120 into the body 100. Put another way, the body may include ribs or protrusions disposed circumferentially about the flow path 116 and extend in the radial direction 120 into the flow path 116. As shown in FIG. 4, as the flow paths 116 extend in the axial direction, the lobes or protrusions may rotate in a circumferential direction 122, such that each flow path 116 has a twisting helical shape. The twisting shape of each flow path 116 may generate a swirling movement in the fluids flowing through the flow path 116, generating turbulence and more thoroughly mixing the fluids (e.g., compressed air and fuel). In some embodiments, the cross-sectional shape of the flow paths 116 may change. For example, as illustrated in FIG. 4, the flow paths 116 through the body 100 change from a lobed cross-section to a circular cross section at a plane 124 proximate the second end 108. As discussed above, each flow path 116 may be tapered along its length 126 from the first end 102 to the second end 108. Furthermore, each flow path 116 may tilt inward toward a central axis 128 of the pre-mixer 98 along its length 126, following the generally tapered shape of the pre-mixer 98. The twisting of the flow paths may allow for a reduction in the length 126 of the pre-mixer 98. For example, the pre-mixer 98 may have a length 126 that is 20-30% less than a similar pre-mixer 98 without swirling flow paths 116. A thoroughly mixed fuel-air mixture exits the second end 108 of the pre-mixer 98 and proceeds toward the first combustion zone 52 (see FIG. 2), where the fuel-air mixture is combusted. More thoroughly mixed fuel and air may result in more complete combustion and lower emissions.

Figure 5:
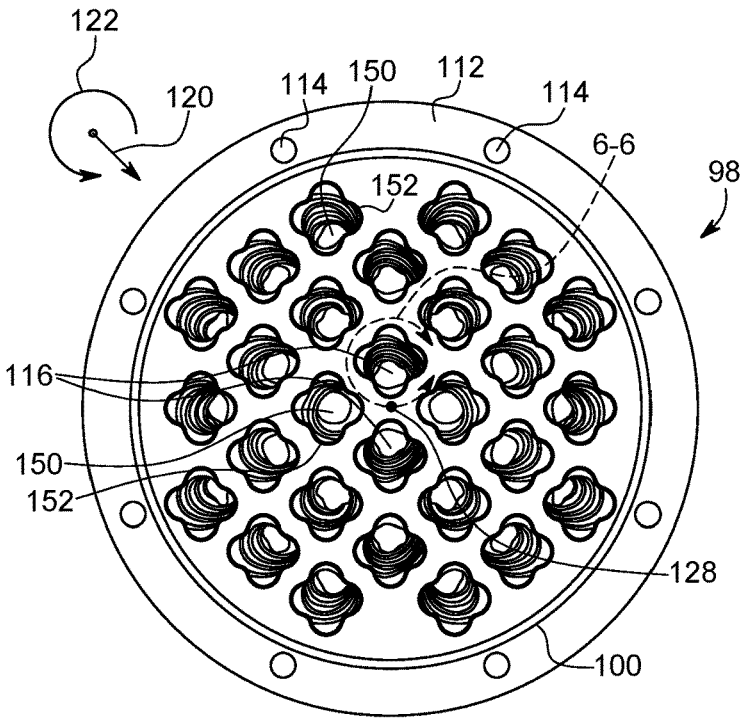
FIG. 5 is a top view of the pre-mixer of FIG. 3 in accordance with an embodiment.

FIG. 5 is a top view of the pre-mixer 98 in accordance with an embodiment. As shown and described above with regard to FIG. 4 above, each flow path 116 may be apered along the length 126 of the flow path 16, and slanted toward the central axis 128 of the pre-mixer 98, forming the generally tapered shape of the pre-mixer 98. Such a tilt can be seen in FIG. 5. For the flow paths 116 near the center of the pre-mixer 98 (e.g., near axis 128), a projection of an outlet 150 of the flow path 116 is only slightly shifted within a projection of an inlet 152 of the flow path. Indeed, the entirely of the outlet 150 appears to be visible through the inlet 152. However, for the flow paths 116 toward the perimeter of the pre-mixer 98, the projection of the outlet 150 is shifted so far toward the center of the pre-mixer 98 (e.g., axis 128) that the projection of the outlet 150 only slightly overlaps with the projection of the inlet 152. Furthermore, the helical pattern formed by the cross-sectional shape of the flow paths 116 rotating in the circumferential direction 122 along the length 126 of the flow paths 116 can be seen in the sidewalls of the peripheral flow paths 116.

Figure 6:
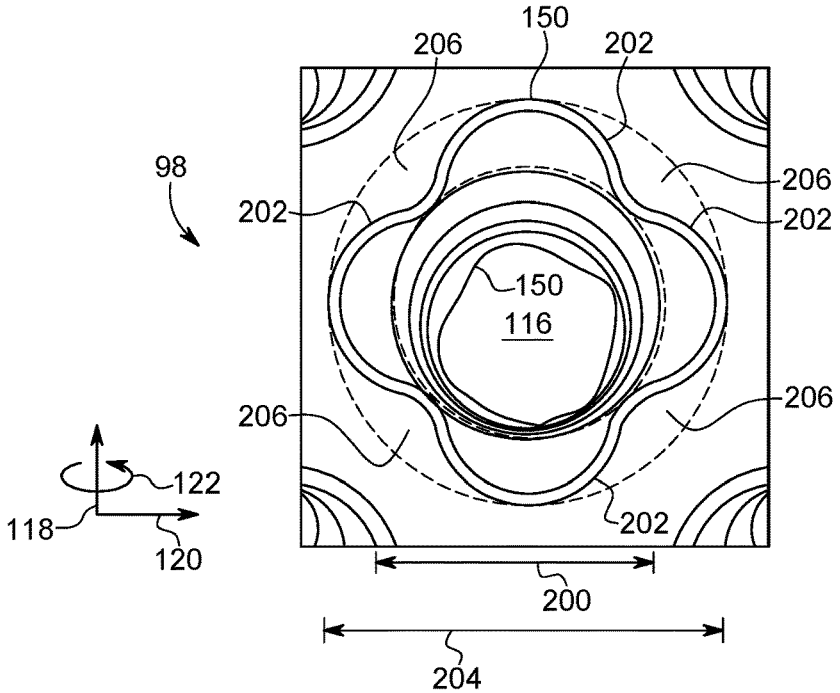
FIG. 6 is a detail top view of the pre-mixer of FIG. 3, taken within line 6-6, in accordance with an embodiment.

FIG. 6 is a detail top view of the pre-mixer 98, taken within line 6-6, in accordance with an embodiment. As described above, the cross section of each flow path 116 may be described as a circular flow path 116 having a first diameter 200 and a plurality of lobes 202 (e.g., semicircular recesses) disposed about the circular flow path 116, and extending in a radial direction 120 outward from the circular flow path 116. Alternatively, the cross section of each flow path 116 may be described as a circular flow path 116 having a second diameter 204 and a plurality of protrusions 206 or ribs disposed about the circular flow path 116, and extending in a radial direction 120 into the circular flow path 116. Though the flow path 116 cross section shown in FIG. 6 shows 4 lobes 202 or protrusions 206, it should be understood that embodiments with different numbers of lobes 202 or protrusions 206 are envisaged. For example, in other embodiments, each flow path 116 may include 2, 3, 4, 5, 6, 7, 8, 9, 10, or more lobes 202 or protrusions 206. Similarly, the lobes 202 or protrusions 206 in some embodiments may be of a different shape than those illustrated herein. Along these lines, embodiments that use other techniques to generate a swirling motion in fluids flowing through the pre-mixer are also envisaged. For example, in some embodiments, the interior walls of the flow paths 116 may utilize differently shaped lobes 202 or protrusions 206, rifling, texturing, or some other technique to generate a swirling motion in fluids flowing through the flow path 116.

Figure 7:
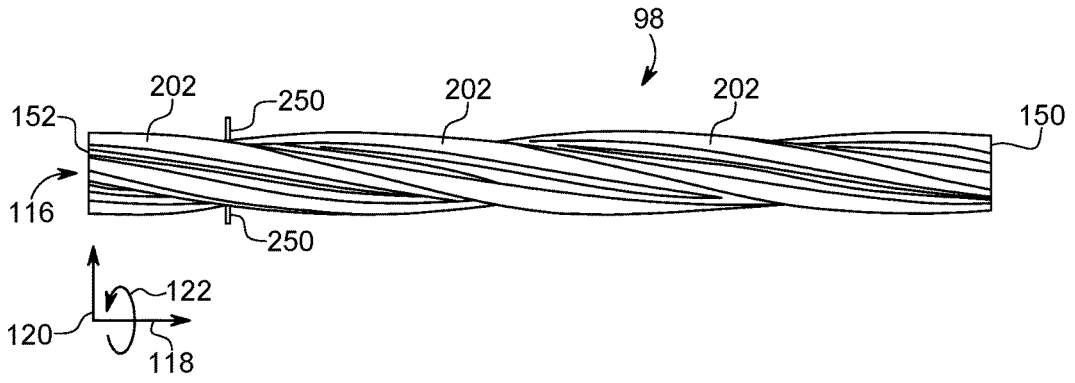
FIG. 7 is a side view of a flow path through the pre-mixer of FIGS. 3-6, in accordance with an embodiment.
Figure 8:
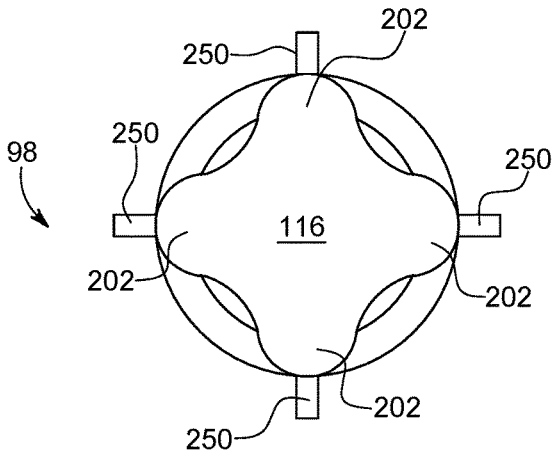
FIG. 8 is a top view of the flow path shown in FIG. 7.

FIG. 7 is a side view of a flow path 116 through the pre-mixer 98 of FIGS. 3-6, in accordance with an embodiment. FIG. 8 is a top view of the flow path 116 shown in FIG. 7. As illustrated, the cross section of the flow path 116 includes 4 lobes 202 extending outward in the radial direction 120. As one moves in the axial direction 118 along the flow path 116, the lobes 202 twist in the circumferential direction 122, forming a spiral or helix shape. In some embodiments, compressed air and fuel (e.g., liquid fuel or gas fuel) may enter the flow path 116 at the inlet 152. For example, in some embodiments, the fuel may be added to the compressed air before the compressed air enters the inlet 152 of the flow path 116, while in other embodiments, the fuel and air may be injected into the inlet 152 simultaneously. In other embodiments, compressed air may enter the flow path 116 via the inlet 152 while fuel is injected perpendicular to or oblique to the compressed air flowing through the flow path via the fuel inlets 250. In further embodiments, an air-fuel mixture may enter the flow path 116 at the inlet 152 and then supplemental fuel may be added to the air-fuel mixture via the fuel inlets 250. The fuel inlets may be circumferentially aligned with, or offset from, the lobes 202. Further, the number of fuel inlets 250 may or may not match the number of lobes 202.

Figure 9:
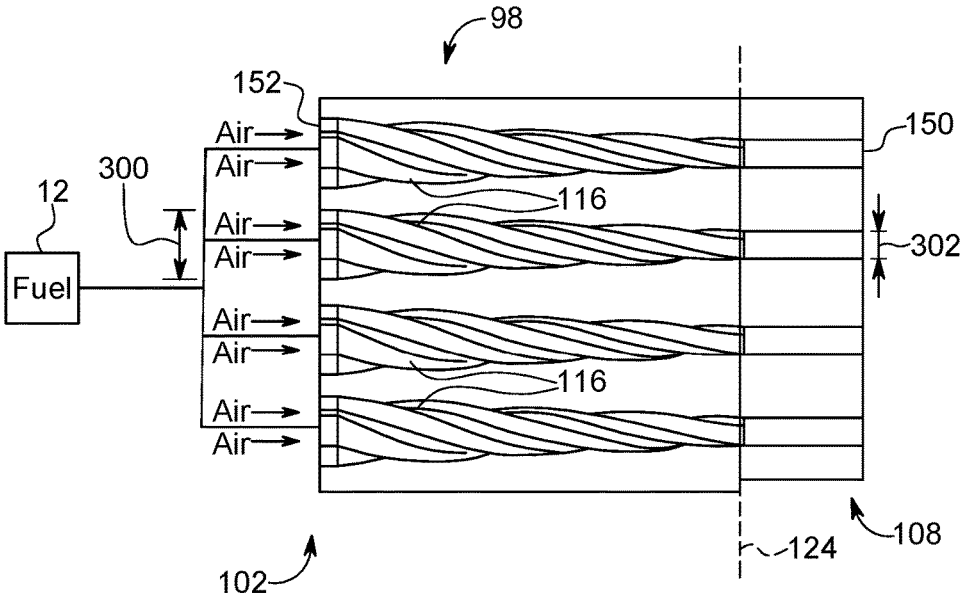
FIG. 9 is a side, section view of the pre-mixer, in accordance with an embodiment, illustrating tapered flow paths.

FIG. 9 is a side, section view of the pre-mixer 98, in accordance with an embodiment, illustrating tapered flow paths 116. As illustrated, the inlet 152 of the flow path 116 at the first end 102 may have a larger diameter 300 than a diameter 302 of the outlet 150 of the flow path 116 at the second end 108. Fuel from a fuel supply 12 may be supplied to the inlet 152 of the passage along with air (e.g., from a compressor). The fuel may be added to the air at the inlet 152, or upstream from the inlet 152. The fuel and air may be injected in a coaxial fashion, adjacent to one another, or in some other configuration. As previously shown and discussed, between a plane 124 and the second end 108 of the pre-mixer 98, the cross sections of the flow paths 116 may change (e.g., become straight, parallel tubes).

Figure 10:
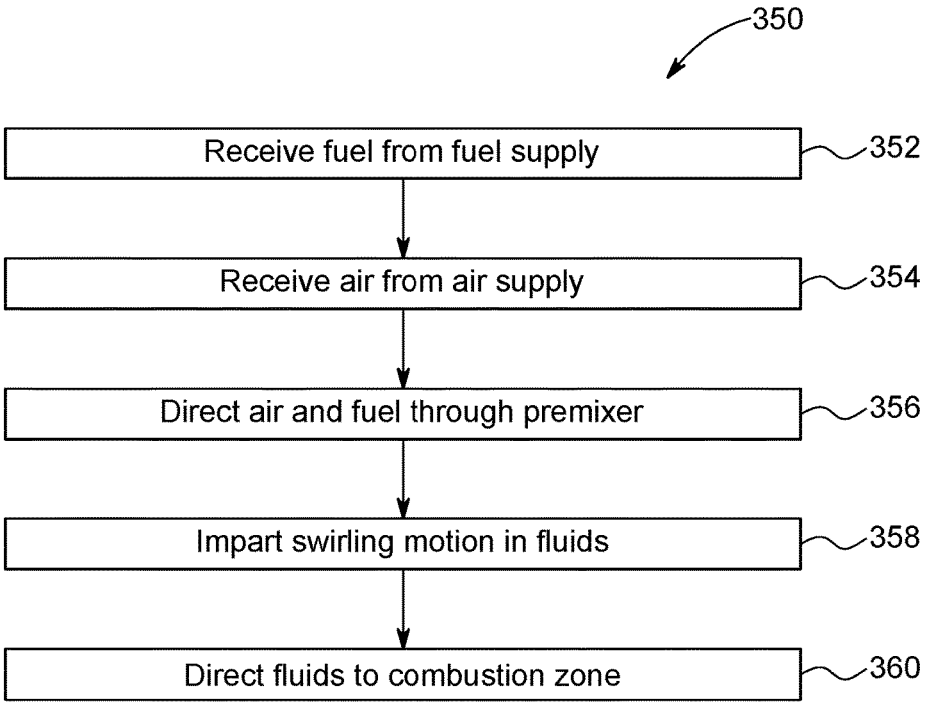
FIG. 10 is a flow chart for a process of mixing air and fuel.

FIG. 10 is a flow chart for a process 350 of mixing air and fuel. In block 352, fuel may be received from a fuel supply (e.g., fuel supply 12). It should be understood that the fuel supply may be a reservoir of fuel (e.g., a fuel tank), or the fuel supply may be a manifold or conduit that provides fuel to one or more pre-mixers 98. In block 354, air, or some other oxidant, may be received from an air supply (e.g., compressor 26). It should be understood that the air supply may be a reservoir of air (e.g., a tank of compressed air), a compressor 26, or a manifold or conduit that provides air to one or more pre-mixers 98.

In block 356, the air and fuel are directed through the pre-mixer 98. In some embodiments, both air and fuel may enter the flow paths 116 of the pre-mixer through the inlets 152 at the first end 102. In other embodiments, only air may enter the flow paths 116 at the inlets 152. In some embodiments, fuel may enter the flow paths 116 via fuel inlets 250, arranged at one or more points along the length 126 of the flow paths 116. Fuel injected via the fuel inlets 250 may be injected perpendicular to, or oblique to the flow direction 110 through the flow paths 116.

In block 358, a swirling motion may be imparted on the fluids flowing through the flow path 116. As discussed above, the cross-section of each flow path 116 may include features (e.g., lobes 202 or protrusions 206) that rotate in a circumferential direction 122 along a length 126 of the flow path 116. The swirling motion mixes the fuel and compressed air. More thoroughly mixed fuel and air results in more complete combustion and lower emissions. In block 360 the fuel-air mixture is directed to the combustion zone 52 of the combustor 16 for combustion.

Figure 11:
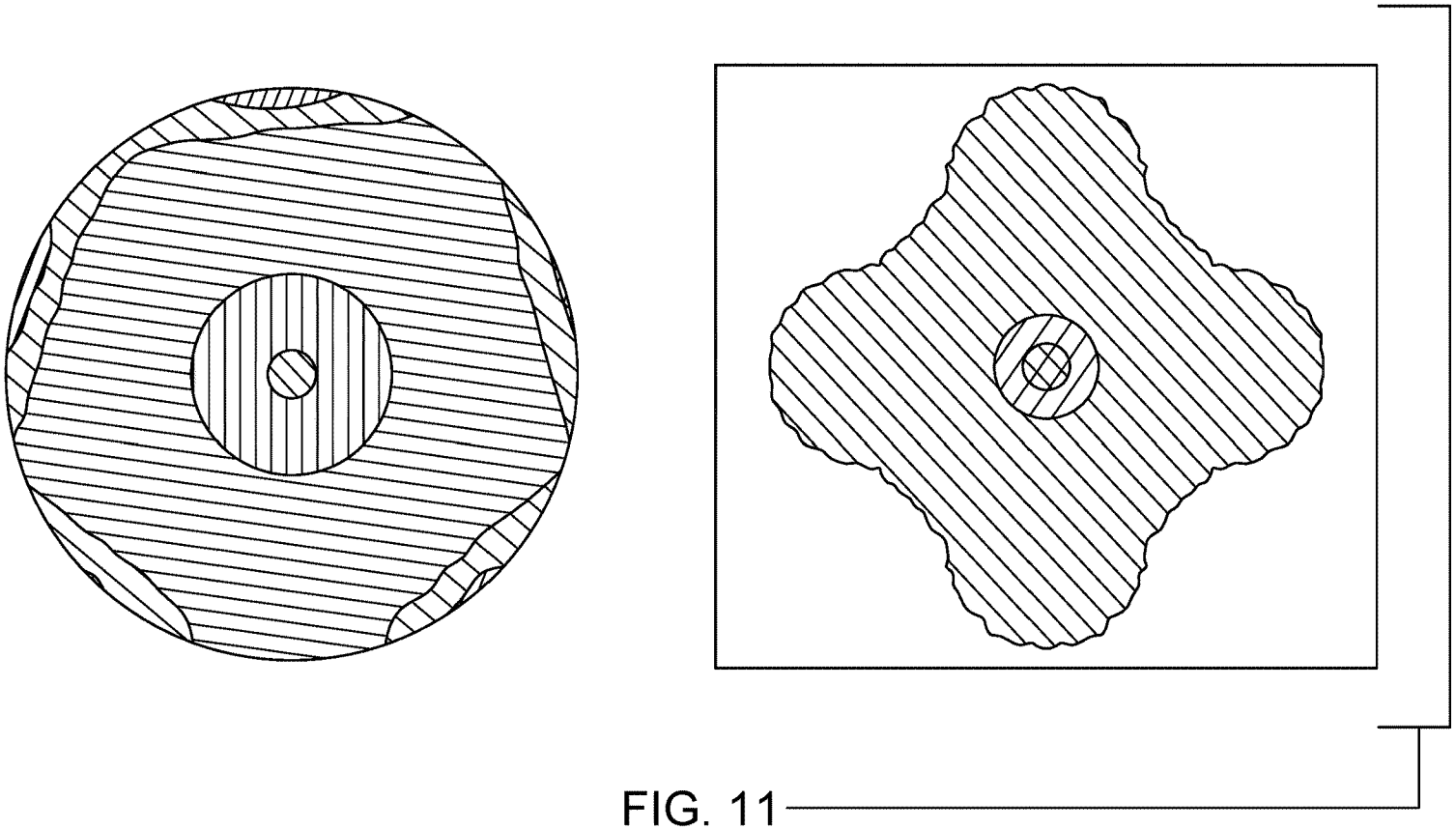
FIG. 11 is an illustration of fuel mass distribution at the outlet of a pre-mixer having circular flow paths (left) and lobed flow paths (right).

FIG. 11 is an illustration of fuel mass distribution at the outlet 150 of a pre-mixer 98 having circular flow paths 116 (left) and lobed flow paths 116 (right). As illustrated, in the circular flow path 116, the fuel mass is very low in the middle, and very high at five locations around the perimeter of the flow path 16. In contrast, for the lobed flow path 116, the fuel mass is somewhat low in the middle, but otherwise relatively evenly distributed, with no pockets of high fuel mass around the perimeter. Accordingly, FIG. 11 appears to confirm that by generating a swirling motion in the fluids that pass through the pre-mixer 98, the fuel-air mixture that exits the outlet 150 of the pre-mixer 98 is much more thoroughly mixed than in comparable, circular cross section flow path 116 pre-mixers 98. A more thoroughly mixed air-fuel mixture may result in more complete combustion, and thus lower emissions. Furthermore, the swirling motion helps to atomize, vaporize, and mix liquid fuel with air, enabling the use of liquid fuels in addition to gaseous fuels. Additionally, the disclosed techniques may result in a jet-stabilized flame, lower dynamics, and higher flame holding margins. In some embodiments, a high exit velocity may be used to reduce or eliminate flame flashback risk.

This written description uses examples to disclose the claimed subject matter, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A gas turbine engine, comprising:

a combustor, comprising:

a pre-mixer comprising a body defining a plurality of fluid passages extending axially through the pre-mixer, wherein a cross-sectional projection of each of the plurality of fluid passages comprises one or more features that form a helical coil about an axis of the fluid passage along a length of the fluid passage, wherein a cross sectional area of each fluid passage of the plurality of fluid passages decreases from a first end of the pre-mixer to a second end of the pre-mixer, downstream from the first end, wherein the pre-mixer is configured to:

receive fuel from a fuel supply;

receive air from an air supply;

mix the fuel and air by flowing the fuel and air through the plurality of fluid passages, and imparting a swirling motion on the fuel and air; and supply the air-fuel mixture to a combustion zone;

wherein the combustor is configured to combust the air-fuel mixture, generating combustion fluids; and a turbine configured to receive the combustion fluids from the combustor and to use the combustion fluids to drive one or more stages of the turbine.

2. The gas turbine engine of claim 1, wherein the one or more features comprise semi-circular lobes disposed about the fluid passages and extending radially outward into the body.

3. The gas turbine engine of claim 1, wherein the body of the pre-mixer is tapered from the first end of the pre-mixer to the second end of the pre-mixer, downstream from the first end.

4. The gas turbine engine of claim 1, wherein the pre-mixer is configured to mix a liquid fuel with the air.

5. The gas turbine engine of claim 1, wherein the pre-mixer comprises a fuel inlet configured to supply fuel to a fluid passage of the plurality of fluid passages.

6. The gas turbine engine of claim 5, wherein the fuel inlet is configured to supply fuel at an angle perpendicular to or oblique to the axis of the fluid passage.

7. A pre-mixer for a gas turbine combustor, comprising:

a body defining a plurality of fluid passages extending axially through the pre-mixer, wherein a cross-sectional projection of each of the plurality of fluid passages comprises one or more features that form a helical coil about an axis of the fluid passage along a length of the fluid passage, wherein a cross sectional area of each fluid passage of the plurality of fluid passages decreases from a first end of the pre-mixer to a second end of the pre-mixer, downstream from the first end, wherein the pre-mixer is configured to:

receive fuel from a fuel supply;

receive air from an air supply; and mix the fuel and air by flowing the fuel and air through the plurality of fluid passages, and imparting a swirling motion on the fuel and air.

8. The pre-mixer of claim 7, wherein the one or more features comprise semi-circular lobes disposed about the fluid passages and extending radially outward into the body.

9. The pre-mixer of claim 7, wherein the one or more features comprise protrusions about the fluid passages and extending radially into each of the plurality of fluid passages.

10. The pre-mixer of claim 7, wherein the body of the pre-mixer is tapered from the first end of the pre-mixer to the second end of the pre-mixer, downstream from the first end.

11. The pre-mixer of claim 7, wherein fuel and air enter each fluid passage of the plurality of fluid passages at an inlet disposed at a first end of the fluid passage.

12. The pre-mixer of claim 7, comprising a fuel inlet configured to supply fuel to a fluid passage of the plurality of fluid passages.

13. The pre-mixer of claim 12, wherein the fuel inlet is configured to supply fuel at an angle perpendicular to or oblique to the axis of the fluid passage.

14. A method of mixing fuel and air in a pre-mixer of a gas turbine engine combustor, comprising:

receiving fuel from a fuel supply;

receiving air from an air supply;

directing the air and fuel through a plurality of fluid passages of a pre-mixer, wherein a cross-sectional projection of each of the plurality of fluid passages comprises one or more features that form a helical coil about an axis of the fluid passage along a length of the fluid passage, wherein a cross sectional area of each fluid passage of the plurality of fluid passages decreases from a first end of the pre-mixer to a second end of the pre-mixer, downstream from the first end; and directing the fuel and air to a combustion zone of a combustor.

15. The method of claim 14, wherein the fuel is a liquid fuel.

16. The method of claim 14, wherein the one or more features comprise semi-circular lobes disposed about the fluid passages and extending radially outward into a body of the pre-mixer.

17. The method of claim 14, wherein fuel is received via a fuel inlet configured to supply fuel at an angle perpendicular to or oblique to the axis of the fluid passage.

* * * * *